United States Patent [19]

Kerttula et al.

[11] Patent Number: 4,543,160

[45] Date of Patent: Sep. 24, 1985

[54] METHOD AND DEVICE FOR GUIDING THE LEADER OF THE WEB IN THE DRYING SECTION OF A PAPER MACHINE

[75] Inventors: Reima Kerttula, Jyväskylä; Pekka Eskelinen, Turku, both of Finland

[73] Assignee: Valmet Oy, Finland

[21] Appl. No.: 653,825

[22] Filed: Sep. 24, 1984

[30] Foreign Application Priority Data

Oct. 3, 1983 [FI] Finland ..... 833590

[51] Int. Cl.[4] ..... D21F 7/00; D21F 1/36; D21F 2/00

[52] U.S. Cl. ..... 162/193; 162/255; 162/286; 226/91; 226/97

[58] Field of Search ..... 162/192, 255, 232, 286; 34/120; 226/7, 91, 97

[56] References Cited

U.S. PATENT DOCUMENTS

| | | | |
|---|---|---|---|
| 1,688,267 | 10/1928 | Cram | 162/193 |
| 4,014,740 | 3/1977 | Koponen et al. | 162/193 |
| 4,022,366 | 5/1977 | Rooney | 162/286 |
| 4,501,643 | 2/1985 | Kiuru | 162/193 |

FOREIGN PATENT DOCUMENTS

| | | | |
|---|---|---|---|
| 323492 | 2/1972 | U.S.S.R. | 162/255 |

*Primary Examiner*—S. Leon Bashore
*Assistant Examiner*—K. M. Hastings
*Attorney, Agent, or Firm*—Steinberg & Raskin

[57] ABSTRACT

In a method for guiding the leader of the web in the drying section of a paper machine, a narrow leader is cut out of the full-width web by water jets, or the equivalent, such as, for example, against a roller of the press section. The leader is guided by a plurality of air jets into a gap between threading ropes and is carried between the threading ropes over drying cylinders. The leader is detached from a rock roller of the press section by a first plurality of air jets and is guided by a second plurality of air jets into connection with a drying wire in the drying section of the paper machine. A third plurality of air jets are directed through the drying wire to the leader supported on the drying wire and detach the leader from the drying wire. Substantially immediately upon detachment of the leader from the drying wire, transverse air jets are directed at the leader and shift the leader into the gap between the threading ropes and move the leader between the threading ropes over the drying cylinders.

17 Claims, 8 Drawing Figures

METHOD AND DEVICE FOR GUIDING THE LEADER OF THE WEB IN THE DRYING SECTION OF A PAPER MACHINE

BACKGROUND OF THE INVENTION

The present invention relates to a method and device for guiding the leader of the web in the drying section of a paper machine.

The invention relates to a method of guiding the leader of the web in the drying section of a paper machine. In this method, a narrow leader is cut out of a full-width web by water jets or the equivalent, against a roller of the press section, for example. The leader is guided by air jets into the gap between the threading ropes and is carried between the threading ropes over the drying cylinders.

The invention also relates to a device for undertaking the method of the invention, which device is provided after the press section of the paper machine at the initial end of the drying section. The device comprises blowing means by which the leader of the web is guided and a pair or group of threading ropes, running in guide grooves formed in an extension of the mantles of the drying cylinders.

As is known in the prior art, when a paper machine is started or after a break of the web, the end of the web is threaded through the drying section by cutting a narrow leader strip out of the web against a rock roller, for example, by a water jet. The leader has a width of about 200 mm and is threaded manually to the threading devices by air jets. As is known in the prior art, the threading devices in the drying section of a paper machine comprise pairs of ropes, each drying group being provided with ropes running over pulleys placed in connection with the ends of the drying cylinders. Usually, the leader is guided between two ropes, an outer and an inner rope, but in some paper machines three jointly operative ropes are used.

The constant increase in the running speeds of paper machines has resulted in increasing difficulties in the threading of the end of the web. The maximum difficulties occur right after the press section and in the initial drying section, as well as in the zones between drying groups.

When prior art threading arrangements are used, the leader must be guided manually at several points in the drying section by air jets placed at the ends of hoses. This work is very dangerous, because it must be performed in immediate proximity to revolving massive components. Furthermore, the operator must be well accustomed to the work and have good professional skill in order to adequately do the work.

SUMMARY OF THE INVENTION

The principal object of the invention is to provide a method and device for guiding the leader of the web in the drying section of a paper machine, which method and device avoid the drawback of the prior art devices and provide more reliable and faster threading.

An object of the invention is to provide a method and device for guiding the leader of the web in the drying section of a paper machine, which device may be extensively automated, thereby substantially reducing or completely eliminating the risky manual steps and making the practice of said method safe.

The threading of the leader has been made more difficult by the long open gap in the zones between the drying groups of the paper machine. Thus, another object of the invention is to provide a method and device for guiding the leader of the web in the drying section of a paper machine, which method and device provide considerably easier threading than heretofore by utilizing a closed draw in the zones between groups, which draw contributes to an increase in the speed of the paper machine, and by making the covering angles of the drying wires larger, thereby increasing the evaporating capacity.

In order to attain the foregoing objects and those later noted, the method of the invention has the following steps.

The leader is detached from the roller of the press section by air jets and is guided by other jets into connection with the drying wire in the drying section of the paper machine.

Air jets are directed through the drying wire at the leader supported on said wire. These air jets detach the leader from the drying wire.

Substantially immediately after the detachment of the leader from the drying wire, transverse air jets are directed at said leader and cause it to shift into the gap between the threading ropes and to pass between the threading ropes over the drying cylinders.

The device of the invention comprises a blow box, or the equivalent, placed inside the loop of the drying wire in the drying section in proximity with the straight run and one edge of said drying wire. The blow box has nozzle openings opening towards the drying wire. Blow means are provided facing the blow box, slightly forward in the running direction of the drying wire. The blow means provide transverse air jets substantially parallel to the plane of the drying wire and directed at the leader detached from the drying wire at the blow box.

The device of the invention permits the cut leader to be guided more reliably into the rope threading in the drying section by using the closed draw and guide and support blowers in a manner hereinafter described in greater detail. The various components of the device of the invention may be connected advantageously to automatic controls, which results in facilitation of the work of paper machine personnel to a significant extent and reduction in the number of dangerous working steps.

When the method and device of the invention are applied in the zones between groups, it is possible to increase the speed of the paper machine by the closed draw. Furthermore, it is possible to make the covering angles of the wires larger and thereby to increase the evaporating output, by the method and device of the invention.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
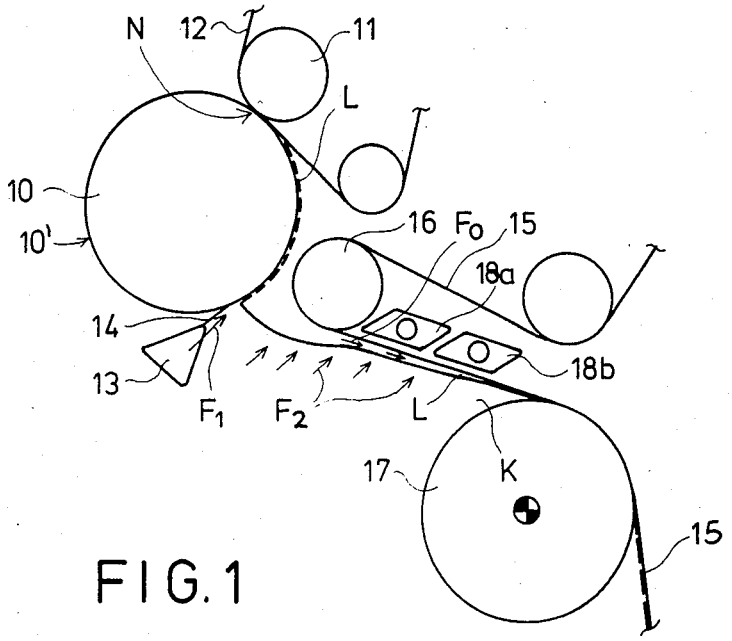
FIG. 1 is a schematic side view of part of an embodiment of the device of the invention, illustrating the first step of the method of the invention, wherein the leader is detached from the smooth-surfaced center roller of the press section and passed into connection with the drying wire.

In FIG. 1, the press section of the paper machine includes a center roller 10 such as, for example, a rock roller, having a smooth surface 10'. Two nips, of which one nip N is shown in FIG. 1, are usually formed in connection with the center roller 10. The nip N is formed between a press roller 11 and the center roller 10 and is provided with a press felt 12.

A narrow leader strip L, of a width of about 200 mm, is cut from the full-width web on the center roller 10 by water jet devices. The leader $L_1$ as well as the whole web are detached from the smooth surface 10' of the center roller 10 by a blade 14 of a doctor 13. The leader $L_1$ is guided forward by the air jets $F_1$, whereas the rest of the web falls to the reject carriage or treatment equipment (not shown in the FIGS.), placed underneath, usually in the basement.

Figure 2:
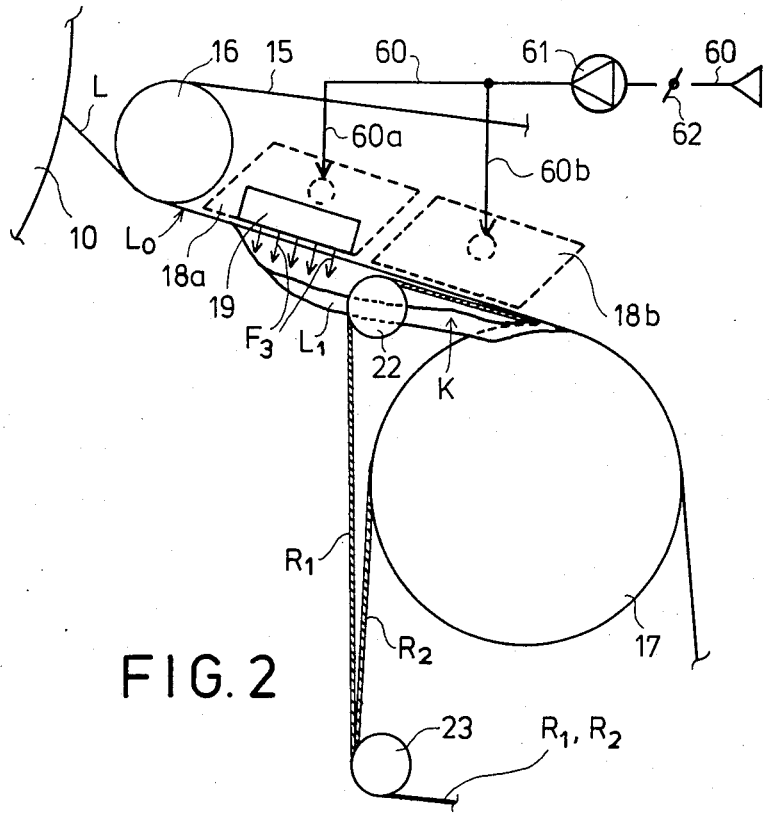
FIG. 2 is a schematic view of part of the device of FIG. 1, showing the second step of the method of the invention, wherein the leader is detached from the drying wire and shifted into the gap between the threading ropes.

In accordance with FIGS. 1 and 2, a drying wire 15, which is a so-called single-draw fabric, for example, guided by a guide roller 16, is passed to proximity with the center roller 10. Blow boxes 18*a* and 18*b* are provided on the straight run of the drying wire 15, inside said drying wire loop, between the guide roller 16 and a baby cylinder 17. The blow boxes 18*a* , and 18*b* are constructed and function as described in applicant's assignee's U.S. application Ser. No. 595,969 filed April 2, 1984. The blow boxes 18*a* and 18*b* are fitted over the entire width of the web and have one or more nozzle slots from which several air jets are blown onto the drying wire 15 at a speed substantially higher than the speed of movement of said drying wire. These air jets cause air to be ejected out of the space between said drying wire and said blow boxes. This blown air produces an effect of negative pressure, illustrated by arrows $F_o$. Furthermore, the leader strip L may be guided into connection with the drying wire or fabric 15 by support jets $F_2$ from below, which guide said leader strip after the doctor jet $F_1$.

Figure 5:
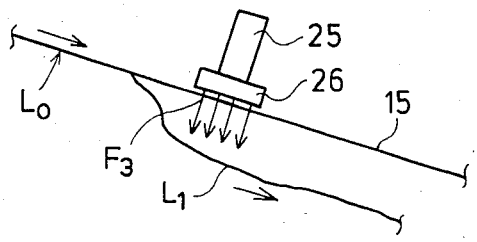
FIG. 5 is a schematic diagram illustrating the detachment of the leader, which has been made to adhere to the drying wire, from said drying wire.
Figure 6:
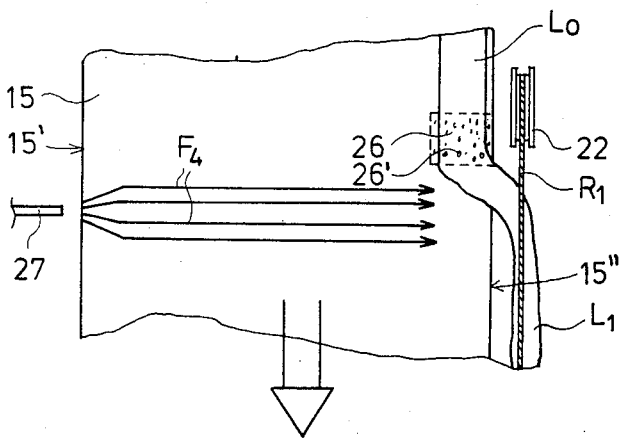
FIG. 6 is a schematic diagram showing the step of the method of the invention after the step shown in FIG. 5, wherein the leader is guided laterally into the gap between the threading ropes.

After the running of the leader L, connected with the edge portion of the drying wire 15, has been stabilized, the next step in the method of the invention illustrated by FIGS. 2 and 5, is undertaken. As shown in FIG. 2, a blow box 19 is provided at the leader, inside the loop of the drying wire 15. Correspondingly, a blow box 26, provided with nozzle holes 26' is placed against the inner surface of the drying wire 15 loop, as shown in FIG. 5. An air supply pipe 25 passes into the blow box 26. Strong local air jets $F_3$ produced by the blow boxes 19 and 26 are directed through the drying wire 15 at the leader $L_o$ placed on the outer surface of said drying wire 15. In this manner, the leader $L_o$ is detached from the surface of the drying wire 15, whereat the leader $L_1$ is ready to be shifted, in the following step of the method of the invention, by the effect of lateral air jets $F_4$ transversely to the outside of one side edge 15'' of said drying wire (FIG. 6). The lateral jets $F_4$ are produced by blowing devices 27, as shown in FIG. 6. The leader $L_1$ is thus shifted into the gap K between threading ropes $R_1$ and $R_2$ and is supported between said ropes into connection with the baby cylinder 17.

Figure 7:
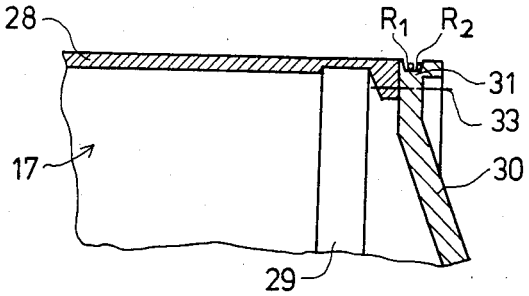
FIG. 7 is an axial section of the end of a drying cylinder, provided with a groove for the threading ropes.

As shown in FIG. 7, the baby cylinder 17 and the other drying cylinders 20 and 21 are provided with mantles 28, to which an end 30 is attached by means of screws 33. The radius of the end 30 is equal to the radius of the mantle 28. The end 30 has a groove 31 formed therein in which the ropes $R_1$ and $R_2$ run.

Figure 3:
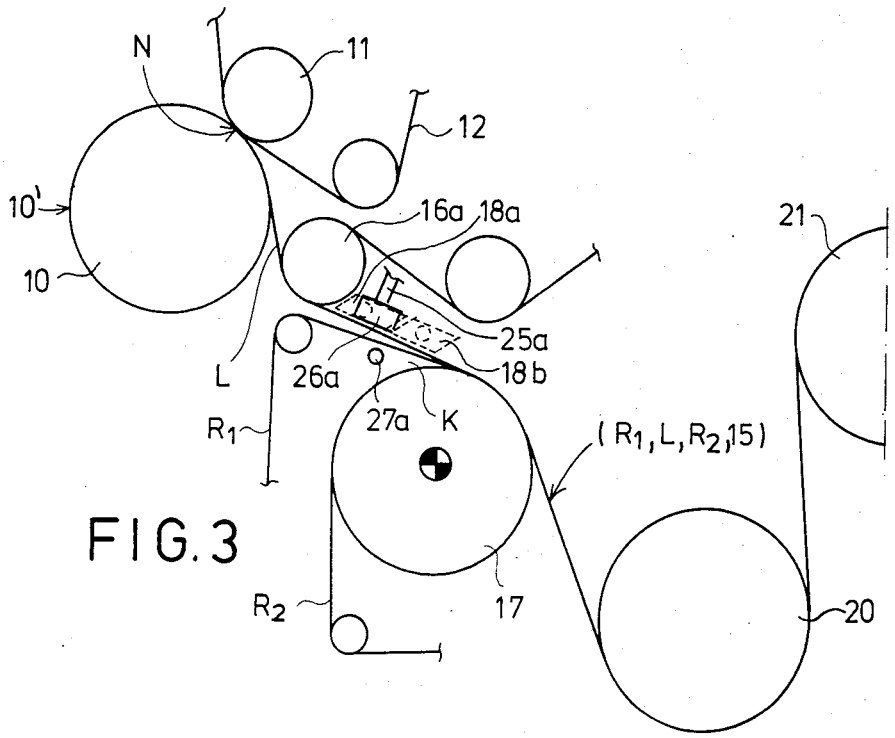
FIG. 3 is a schematic side view of a first embodiment of the device of the invention and illustrates how the leader is guided in connection with the drying wire.

In FIG. 3, the leader L has been guided in the aforedescribed steps into the gap K between the threading ropes $R_1$ and $R_2$ by blowing devices 26*a* and 27*a*. The leader L then moves between the ropes $R_1$ and $R_2$ over the baby cylinder 17 and onto the drying cylinders 20 and 21, etc.

Figure 4:
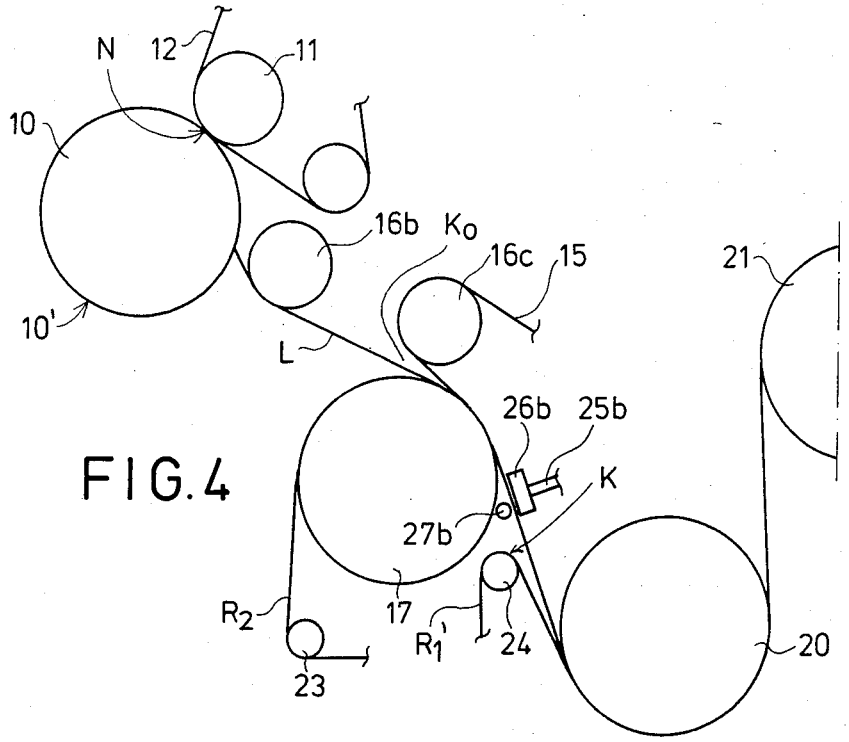
FIG. 4 is a schematic side view of a second embodiment of the device of the invention, wherein the rope gap between the threading ropes is located on the run of the drying wire and the web after the baby cylinder.

In the second embodiment of the invention, shown in FIG. 4, the leader L is passed into a gap $K_o$ between the baby cylinder 17 and the drying wire 15, being guided by a guide roller 16*b* by air jet devices, for example (not shown in the Figs.). The drying wire 15 is passed into connection with the baby cylinder 17, as guided by a guide roller 16*c*. As shown in FIG. 4, the shifting of the leader L to a position between the ropes $R_1$ and $R_2$ does not occur until after the baby cylinder 17, and is accomplished by blowing devices 25*b*, 26*b* and 27*b*. The construction and operation of the blowing devices 25*b*, 26*b* and 27*b* are substantially similar to those of the blowing devices 19, 25, 26, 27, 26*a* and 27*a*, hereinbefore described.

The gap K between the ropes $R_1$ and $R_2$ is formed before the first drying cylinder 20 proper (FIG. 4), whose end 30 is provided with the rope groove 31, shown in FIG. 7. The leader L is guided into the gap K by the blowing devices 25*b*, 26*b* and 27*b* in the manner shown in FIGS. 5 and 6 and described with reference thereto.

Guide pulleys 22, 23 and 24 are provided for the threading ropes (FIGS. 2, 3, 4 and 6).

Figure 8:
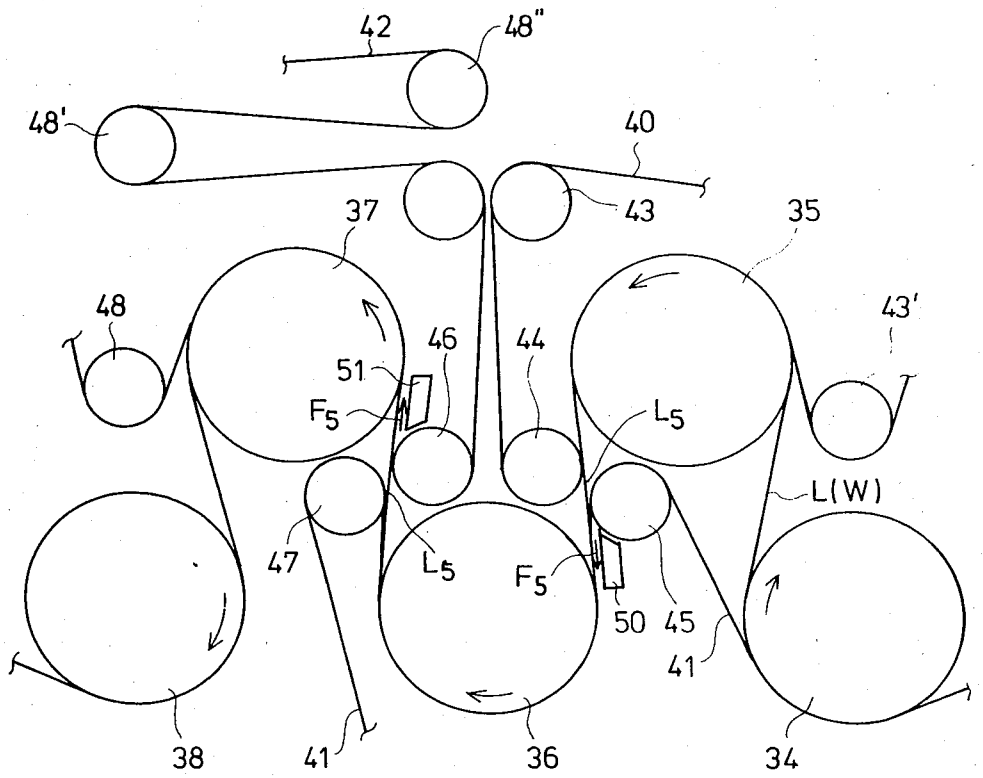
FIG. 8 is a schematic diagram of the embodiment of FIG. 3 duplicated in an application of the device of the invention in the zones between groups of drying cylinders.

In FIG. 8, a preceding group has drying cylinders 34, 35 and 36, and a succeeding group has drying cylinders 37 and 38. The former group includes an upper wire 40 guided by guide rollers 43 and 44 and a lower wire 41 guided by guide rollers 45 and 47. The latter group includes an upper wire guided by guide rollers 46 and 48. The wire guide rollers 44 and 45, in pairs, and, correspondingly, the wire guide rollers 46 and 47, in pairs, are placed in overlapping relation with each other, in accordance with the lick-up principle. An almost closed draw and, in any case, very short zones $L_5$ between groups are obtained for the web W. A blow box 50 is provided inside the loop of the wire 41, before the drying cylinder 36, at the zones between groups, as shown in FIG. 8. Correspondingly, a blow box 51 is provided inside the wire 42 loop, before the drying cylinder 37.

The blow boxes 50 and 51 produce a suction effect based on ejection in the direction of arrows $F_5$ on the leader $L_5$. Threading free from disturbances is thereby promoted in the zones between groups. The support air jets $F_5$ and the blow boxes 50 and 51 may also be extended in order to cover the entire width of the machine, whereby the running of the full-width web W is stabilized in the zones between groups, corresponding to the threading of the leader $L_5$. The blow boxes 50 and 51, as well as the support jets $F_5$ generated by said blow boxes, function in accordance with the same principle as the aforedescribed blow boxes 18*a* and 18*b*, so that reference is also made, in this connection, to applicant's assigness's said application Ser. No. 595,969.

Some examples of automatic control of the method of the invention are hereinafter described. FIG. 2 shows a pipe 60, through which pressurized air is introduced by means of a blower 61, such as, for example, a pocket blower device of a multi-cylinder dryer, through pipes 60*a* and 60*b* to the blow boxes 18*a* and 18*b*. In principle, the blower 61 is in operation continuously when the paper machine is in operation. When a web break occurs, a grating 62 is closed automatically under the control of the break. In practicing the method of the invention, the threading is started by running a full-width web by the doctor 13 to the reject conveyor underneath the device. In the next stage, the jets $F_3$, produced by the blow box 19, 26 connected with the blow boxes 18*a* and 18*b*, are directed through the drying wire 15. Either slightly later, or simultaneously, a compressed air jet $F_4$, at the service or operating side, starts blowing in the transverse direction. In the next stage, the air jets $F_2$ detach the leader strip of the web from the surface 10′ of the rock roller 10. The end of the leader L is blown into the gap K at the desired point, due to the correct direction of the air jets $F_2$. In this way, the leader L can be introduced into the gap K between the threading ropes $R_1$ and $R_2$, whereupon the operation of the devices is immediately controlled so that jets $F_1$, $F_2$ and $F_4$ are stopped. In the next stage, the grating 62 is opened under control and the leader strip is made a little wider, almost simultaneously. In the last stage, trimmings of the draws or other operations, known in themselves, are performed.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for guiding a leader of a web in a drying section of a paper machine, said paper machine having threading ropes with a gap therebetween drying cylinders and a drying wire in said drying section and a press section with a roller, said method including cutting a narrow leader out of a full-width web, guiding the leader by air jets into the gap between the threading ropes and carrying said leader between the threading ropes over the drying cylinders, said method comprising the sequential steps of detaching said leader from the roller of said press section by first air jets;

guiding the detached leader by second air jets into connection with the drying wire of said drying section;

directing third air jets through said drying wire to the leader supported on said drying wire thereby detaching said leader from said drying wire;

directing transverse air jets at said leader substantially immediately after detachment of said leader from said drying wire thereby shifting said leader into the gap between said threading ropes and moving said leader between said threading ropes over said drying cylinder, , and guiding said drying wire over said drying clinders through said drying section.

2. A method as claimed in claim 1, wherein said roller in said press section is a smooth-surfaced rock roller and said paper machine further has a doctor in operative proximity with said rock roller in said press section and a baby cylinder in said drying section, a gap being formed between said baby cylinder and said drying wire, and wherein said leader is detached from said rock roller of said press section by said first air jets in close proximity with said doctor and directed substantially at the width of said leader only, and said detached leader is guided from below by said second air jets which carry it forward into the gap between said baby cylinder and said drying wire.

3. A method as claimed in claim 2, wherein said paper machine further has a guide roller for guiding the drying wire into immediate proximity with said rock roller and wherein said drying wire extends on a straight run between said guide roller and said baby cylinder and, forms a loop, and wherein said third air jets directed through said drying wire to the leader supported on said drying wire are directed from within the loop of said drying wire at said straight run, are directed onto said drying wire at a speed higher than the speed of movement of said drying wire, eject air out of the space adjacent said drying wire, and are directed through said drying wire in proximity with one of its edges.

4. A method as claimed in claim 3, wherein said paper machine further has a first drying cylinder and wherein said drying wire extends on a straight run between said baby cylinder and said first drying cylinder and said gap between said threading ropes is immediately before said first drying cylinder, and wherein said third air jets directed through said drying wire to the leader supported on said drying wire are directed at said leader at said straight run, and said transverse air jets are directed at said leader at said straight run.

5. A method as claimed in claim 4, wherein said paper machine further has groups of drying cylinders having zones therebetween and upper and lower felts, and further comprising the step of reducing the sensitivity of threading to disturbances at said zones, including producing a suction effect on said leader based on ejection.

6. A method as claimed in claim 5, wherein the sensitivity of threading to disturbances is reduced by directing additional air jets to cover the entire width of said paper machine thereby stabilizing the running of the full-width web in said zones between said cylinder groups.

7. In a paper making machine, a device for guiding a leader of a web in a drying secion of the paper machine said paper mahine having threading ropes with a gap therebetween, drying cylinders and a drying wire in said drying section and a press section with a roller, said device comprising detaching means including first air jets for detaching said leader from the roller of said press section;

guiding means including second air jets for guiding the detached leader into connection with the drying wire of said drying section;

further detaching means for detaching said leader from said drying wire, said further detaching means including third air jets and means for directing said third air jets through said drying wire to the leader supported on said drying wire;

shifting means for shifting said leader into the gap between said threading ropes and moving said leader between said threading ropes over said drying cylinders, said shifting means including transverse air jets and means for directing said transverse air jets at said leader substantially immediately after detachment of said leader from said drying wires and further guiding means for guiding said drying wire over said drying cylinders through said drying section.

8. A device as claimed in claim 7, wherein said roller in the press section is a smooth-surfaced rock roller and said paper machine further has a doctor in operative proximity with said rock roller in said press section and a baby cylinder in said drying section, a gap being formed between said baby cylinder and said drying wire, and wherein said first air jets are in close proximity with said doctor and are directed substantially at the width of said leader only, and said second air jets carry said detached leader from below into the gap between said baby cylinder and said drying wire.

9. A device as claimed in claim 8, further comprising a guide roller for guiding the drying wire into immediate proximity with said rock roller, and wherein said drying wire extends on a straight run between said guide roller and said baby cylinder and forms a loop, and wherein said further detaching means includes blow boxes in the loop of said drying wire at said straight run and having nozzle slots via which a plurality of said third air jets are directed onto said drying wire at a speed higher than the speed of movement of said drying wire, said air jets ejecting air out of the space between said drying wire and said blow boxes, and another blow box associated with one of said blow boxes and directing said third air jets through said drying wire in proximity with one of its edges.

10. A device as claimed in claim 9, further comprising a first drying cylinder, and wherein said drying wire extends on a straight run between said baby cylinder and said first drying cylinder and said gap between said threading ropes is immediately before said first drying cylinder, and wherein said further detaching means directs said third air jets at said leader at said straight run and said shifting means directs said transverse air jets at said leader at said straight run.

11. A device as claimed in claim 10, further comprising groups of drying cylinders having zones therebetween, upper and lower felts and sensitivity reducing means at the zones between the drying cylinders of said groups for reducing the sensitivity of threading to disturbances at said zones, said sensitivity reducing means including additional blow boxes within at least one of said upper and lower felt for producing a suction effect on said leader based on ejection.

12. A device as claimed in claim 11, wherein said additional blow boxes of said sensitivity reducing means provide air jets extending to cover the entire width of said paper machine thereby stabilizing the running of the full-width web in said zones between said cylinder groups.

13. A device as claimed in claim 12, wherein said drying wire in said drying section is formed in a loop having a straight run and an edge, said device being installed after the press section of said machine at an initial end of said drying section, and further comprising blowing means for guiding said leader, mantles on said drying cylinders, said mantles having extensions and each of the extensions having guide grooves formed therein and said threading ropes being positioned in said grooves, a blow box inside the loop of said drying wire in said drying section in proximity with the straight run and the edge of said drying wire, said blow box having nozzle openings opening towards said drying wire, and said shifting means including blow means facing said blow box, slightly forwards in the direction of running of said drying wire, said blow means providing said transverse air jets substantially parallel to the plane of said drying wire and directed at said leader detached from said drying wire at said blow box.

14. A device as claimed in claim 13, wherein said blow means of said shifting means is installed at the straight run of said drying wire between said guide roller and said baby cylinder.

15. A device as claimed in claim 14, wherein said detaching means includes a blow box installed inside the loop of said drying wire at the run of said drying wire between said guide roller and said baby cylinder and extending over the entire transverse width of said drying wire.

16. A device as claimed in claim 15, wherein said blow means of said shifting means is installed at the run of said drying wire between said baby cylinder and said first drying cylinder, and wherein one of said threading ropes is guided over said baby cylinder and the other of said threading ropes is guided over said first drying cylinder thereby forming said gap between said threading ropes before said first drying cylinder, said blow means shifting said leader into said gap.

17. A device as claimed in claim 16, wherein said upper and lower felt are formed in a loop in the zones between the cylinders in said drying section, and wherein said additional blow boxes are placed in said loop.

* * * * *